US006694705B1

(12) United States Patent
Frei et al.

(10) Patent No.: US 6,694,705 B1
(45) Date of Patent: Feb. 24, 2004

(54) DEFOAMING DEVICE FOR A PACKAGING MACHINE

(75) Inventors: Karl Frei, Wil (CH); Sevugan Palaniappan, Sugar Land, TX (US); Robert Massey, Paddock Lake, WI (US); Ken Pokusa, Willowbrook, IL (US)

(73) Assignee: Tetra Laval Holdings & Finance, SA, Pully (CH)

( * ) Notice: Subject to any disclaimer, the term of this patent is extended or adjusted under 35 U.S.C. 154(b) by 0 days.

(21) Appl. No.: 09/743,331

(22) PCT Filed: Jul. 8, 1999

(86) PCT No.: PCT/US99/15384

§ 371 (c)(1),
(2), (4) Date: May 18, 2001

(87) PCT Pub. No.: WO00/02781

PCT Pub. Date: Jan. 20, 2000

(51) Int. Cl.[7] ..... B65B 63/00; B65B 1/20

(52) U.S. Cl. ..... 53/428; 53/565; 53/467; 53/111 R; 141/11

(58) Field of Search ..... 53/428, 440, 458, 53/467, 473, 565, 111 R, 370.7, 7, 122

(56) References Cited

U.S. PATENT DOCUMENTS

| | | | | | |
|---|---|---|---|---|---|
| 3,169,561 | A | * | 2/1965 | Berger et al. | 141/69 |
| 3,703,801 | A | | 11/1972 | Deckas | 55/385 |
| 3,825,408 | A | * | 7/1974 | Farfaglia et al. | 156/497 |
| 4,076,617 | A | * | 2/1978 | Bybel et al. | 210/748 |
| 4,295,502 | A | * | 10/1981 | Matzner | 141/11 |
| 4,784,675 | A | | 11/1988 | Leber et al. | 55/213 |
| 4,895,193 | A | * | 1/1990 | Rangwala et al. | 141/103 |
| 4,938,309 | A | | 7/1990 | Emdy | 181/231 |
| 5,038,548 | A | * | 8/1991 | Sieg | 141/103 |
| 5,288,298 | A | | 2/1994 | Aston | 55/279 |
| 5,447,016 | A | * | 9/1995 | Ueda et al. | 53/370.9 |
| 5,467,247 | A | * | 11/1995 | de Anda et al. | 361/232 |
| 5,622,543 | A | | 4/1997 | Yang | 96/58 |
| 5,743,311 | A | | 4/1998 | Crossdale et al. | 141/31 |
| 5,749,401 | A | | 5/1998 | Shinya et al. | 141/80 |
| 6,375,001 | B1 | * | 4/2002 | Beach | 206/217 |

* cited by examiner

*Primary Examiner*—Rinaldi I. Rada
*Assistant Examiner*—Paul Durand
(74) *Attorney, Agent, or Firm*—Welsh & Katz, Ltd.

(57) ABSTRACT

A defoaming apparatus (22) defoams a foamable product that is dispersed into a container such as a TETRA REX gable-top carton (80). The defoaming apparatus (22) creates a sonic shock wave (110) that destroys most if not all of the bubbles of the foamable product. The defoaming apparatus (22) has a body (100) that defines a recessed cavity (102). A pair of electrodes (106, 108) is located within the recessed cavity (102). The opening to the cavity (102) can include a radio frequency filter (114) covering to absorb radio waves created from the sonic shock wave (110). The defoaming apparatus (22) is preferably disposed immediately after the filling of the container (80).

18 Claims, 6 Drawing Sheets

DEFOAMING DEVICE FOR A PACKAGING MACHINE

FIELD OF THE INVENTION

The present invention relates to defoaming devices for foamable products. Specifically, the present invention relates to a defoaming device utilized on a packaging machine to decrease the foam level in a container prior to sealing of the container.

BACKGROUND OF THE INVENTION

In the packaging industry, productivity is synonymous with the ability to produce a greater number of cartons per hour than previous machines. In the field of form, fill and seal packaging machine, the ability to produce higher capacity machines is accomplished by analyzing, and as necessary, modifying each action performed on the machine. Through analyzing each action performed on the machine, the dwell time may be lessened while the indexed movement is increased in order to achieve higher capacity on the packaging machine. The dwell time is defined as the time period that each preformed container is stationary on the machine while an action is performed on the container. The indexed movement is defined as the time period that each pre-formed container is conveyed along the packaging machine from one station to the next.

For example, on a linear form, fill and seal packaging machine such as a TETRA REX® packaging machine available from Tetra Pak, Incorporated of Chicago, Ill., once a pre-formed container is filled with a product, conveyance of the container must be controlled to prevent sloshing of the product onto the sealing area of the container. However, it is desired to increase the conveyance speed of the product-filled container. To that end, the motion profiles of the conveyance of containers is controlled as set forth in U.S. Patent No. (co-pending U.S. patent application Ser. No. 08/848,888) entitled Servo-Controlled Conveyor System For Carrying Liquid Filled Containers, assigned to the assignee of the present invention.

Another possibility for increasing capacity would be to reduce the number of indexed dwell positions on the conveyor line. One possible dwell position that may be eliminated is the extra dwell position between the filling station and top sealing station. This station allows for the product foam in a recently filled container to settle prior to top sealing, which prevents wetting of the sealing area of the container with product foam. Other packaging machines such as rotary filling machines and vertical form, fill and seal machines have exhibited similar problems with foamable products.

One defoaming technique is set forth in U.S. Pat. No. 4,295,502, entitled "Method And Apparatus For The Elimination Of Foam Above The Level Of A Liquid, And Particularly Above A Packaged Liquid Such As Milk." This technique discloses the use of ultrasonic waves to decrease the product foam in a container through disruption of the foam bubbles. The technique requires ultrasonic equipment positioned above the conveyor line. However, the ultrasonic device will increase the noise level on the packaging machine, and if other ultrasonic devices are employed on the machine, such as ultrasonic fitment applicators, then already high decibel levels may be doubled, coming close to intolerable decibel levels. Safeguards and other additions may be added to the machine to reduce noise, however, this further increases the cost of the packaging machine. Moreover, the use of ultrasonics for defoaming purposes has proven ineffective.

An alternative defoaming device is needed in the packaging industry to increase the packaging capacity of machines. Such a device desirably reduces foaming of the newly filled package, with minimal if any impact on the operating speeds of the overall packaging machine operation. Most desirably, such a device fits within the known physical parameters and sizing of known packaging machines.

SUMMARY OF THE INVENTION

The present invention provides an alternative to ultrasonic defoaming which effectively defoams a container filled with a foamable product. The present invention accomplishes this by providing a defoaming device that creates a shock wave to destroy or collapse the bubbles of a foamable product inside a container after filling.

One aspect of the invention is a defoaming device having a body with a reflective recessed cavity. Inside the cavity are two electrical terminals that, when a voltage is applied to one terminal, an arc is created between the terminals to complete the circuit. The discharge or arc superheats the air inside of the recessed cavity to create a shock wave. The shock wave is directed toward the container to destroy the bubbles of the foam.

Another aspect of the invention is a packaging machine having such a defoaming device positioned between a filling station and a top sealing station. Yet another aspect of the invention is a method for defoaming a carton filled with a foamable product. It is a primary object of the present invention to provide a method and apparatus to defoam pre-formed containers filled with a product on a packaging machine.

Other features and advantages of the present invention will be apparent from the following detailed description, in conjunction with the accompanying drawings, and the appended claims.

DETAILED DESCRIPTION OF THE PREFERRED EMBODIMENTS

Figure 1:
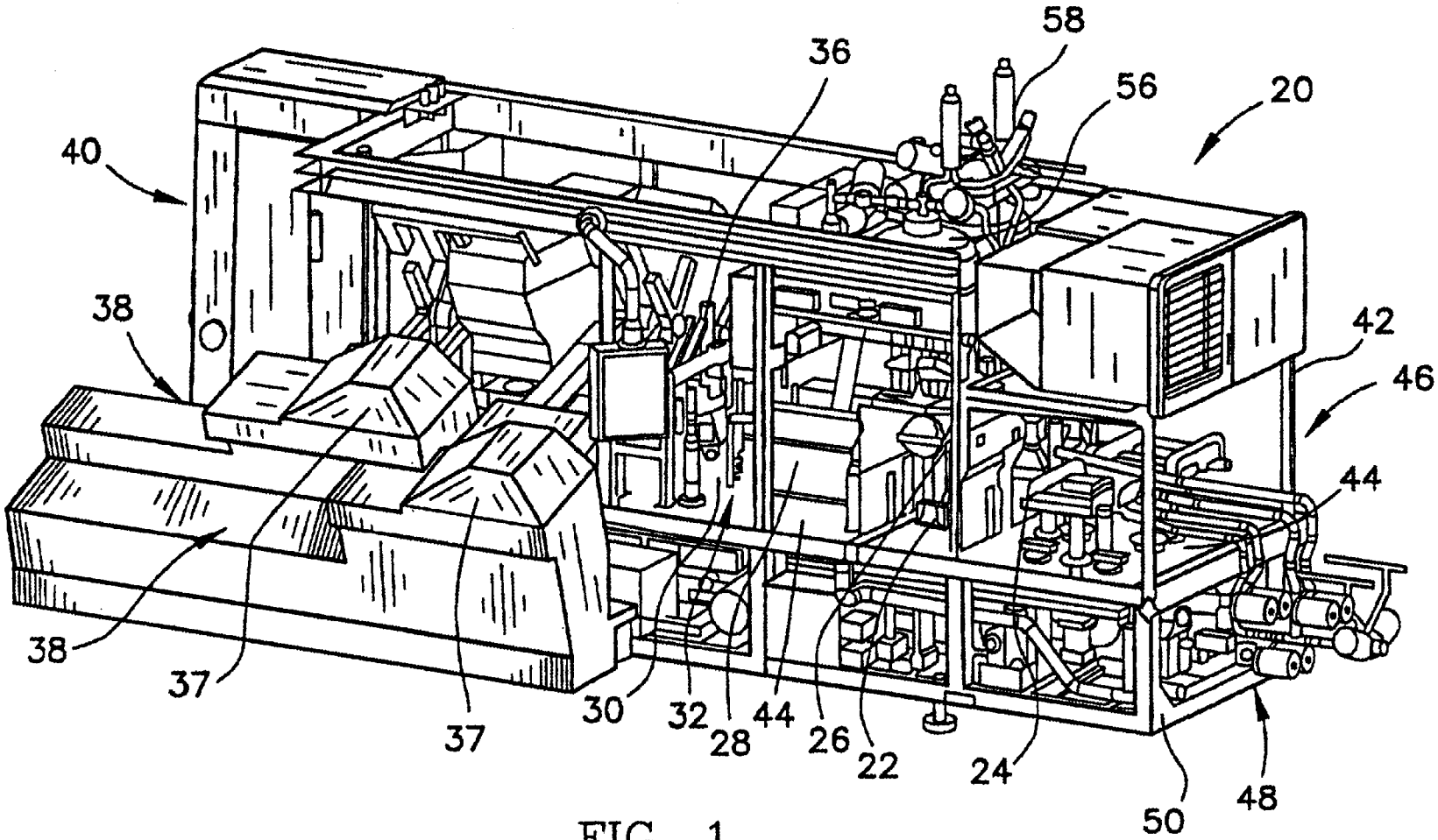
FIG. 1 is a top perspective view of a packaging machine.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

The present invention is directed toward a form, fill and seal packaging machine, for example a linear packaging machine for gable-top cartons such as a TETRA REX® machine available from Tetra Pak, Incorporated of Chicago, Ill. Those skilled in the art will, however, recognize that the present invention may be utilized with other machines to defoam a foamable product. Linear packaging machines may process one, two or any multiple of cartons simultaneously with each multiple of cartons being conveyed one indexed movement from station to station. The present invention allows for cartons filled with a foamable product to be defoamed prior to pre-folding and/or top sealing.

As shown in FIG. 1, a dual line packaging machine 20 for forming, filling and sealing cartons generally includes a defoaming device 22, a top sealing station 24 and a filling station 26, a sterilization station 28 which is composed of an ultraviolet radiation station 30 and a hydrogen peroxide station 32, a bottom forming station 36, a carton opener 37, and a carton blank magazine 38. From an operational perspective, the front 40 of the packaging machine 20 is where the processing begins, and the rear 42 is where the finished cartons are dispensed for distribution.

The packaging machine 20 may be divided along a horizontal plane defined by a table top 44. The table top 44 divides the packaging machine 20 into an upper half 46 and a lower half 48. A frame 50 defines the general structure of the packaging machine 20 and supports the table top 44 and the various stations. The lower half 48 of the machine 20 includes servomotors, drive cylinders, cam drives and other components. The upper half 46 includes the various stations, the product tank 56, the filtered air system 58, the conveyor system 60, not shown in FIG. 1, and other components to process the cartons.

Figure 2:
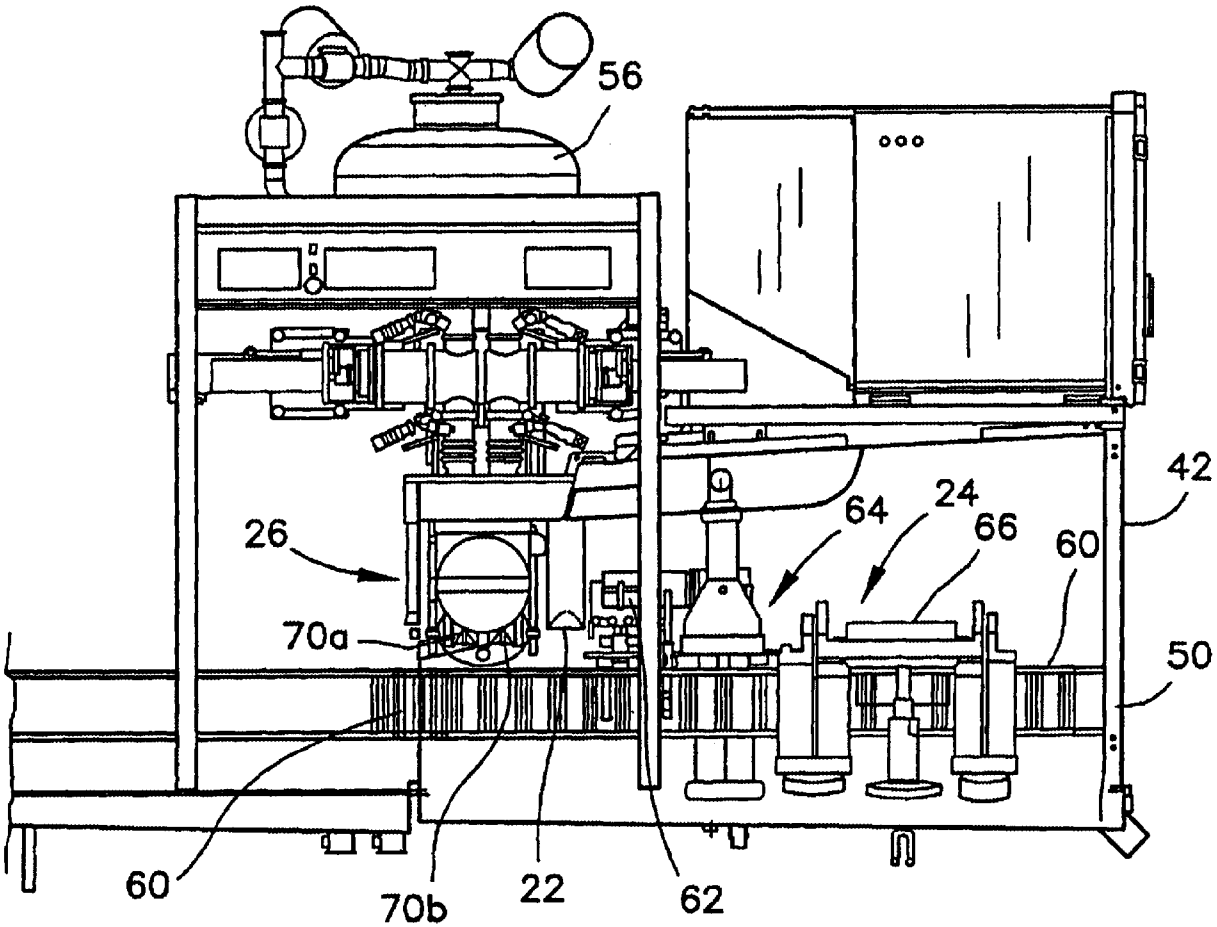
FIG. 2 is an isolated view of the fill pipe, defoaming device, prefolder and top sealer of the packaging machine of FIG. 1.

As shown in FIG. 2, the defoaming device 22 is positioned between the filling station 26 and a pre-folder station 62. Such a filling station 26 is described in co-pending U.S. patent application Ser. No. 08/897,554, entitled "Dual Stream Filling Valve" and in copending U.S. patent application Ser. No. 08/816,056, entitled "Elliptical Cleaning Box For Filling Apparatus," both of which are hereby incorporated by reference.

Further down line at the top sealing station 24 is an oven 64 for heating the panels for sealing, and the top sealer device 66 for sealing the top fin panels of a carton together to create a form, filled and sealed carton. The top fin panels form the sealing area as described below. Preferably the defoaming device 22 will cover two open top cartons being processed on a dual carton processing packaging machine 20. For example, two cartons are filled simultaneously at two fill pipes 70*a–b*, then conveyed to the defoaming device 22 in the next indexed movement to be defoamed, if necessary. Both cartons are conveyed under the defoaming device 22 for defoaming before the pre-folding station 62.

Alternatively, although not shown, two smaller defoaming devices 22 can be used, with one device each being positioned over a carton for individually and independently defoaming the cartons before pre-folding at the pre-folder station. In still another alternative (also not shown) one carton is defoamed during the dwell while the other carton is defoamed during the indexed movement. Additionally, the packaging machine 20 may process only a single carton at each station, or it may process a multiple of cartons at each station. The defoaming device can be modified to accommodate any of the above alternatives, or any multiple of cartons processed in an indexed movement on the packaging machine 20, without departing from the scope and spirit of the present invention.

Figure 3:
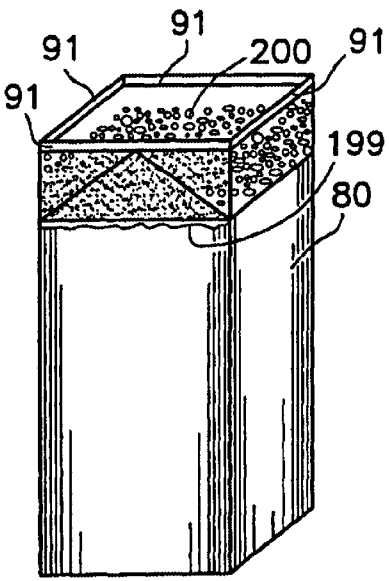
FIG. 3 is a partial cross-section side view of an open ended gable top carton.
Figure 2A:
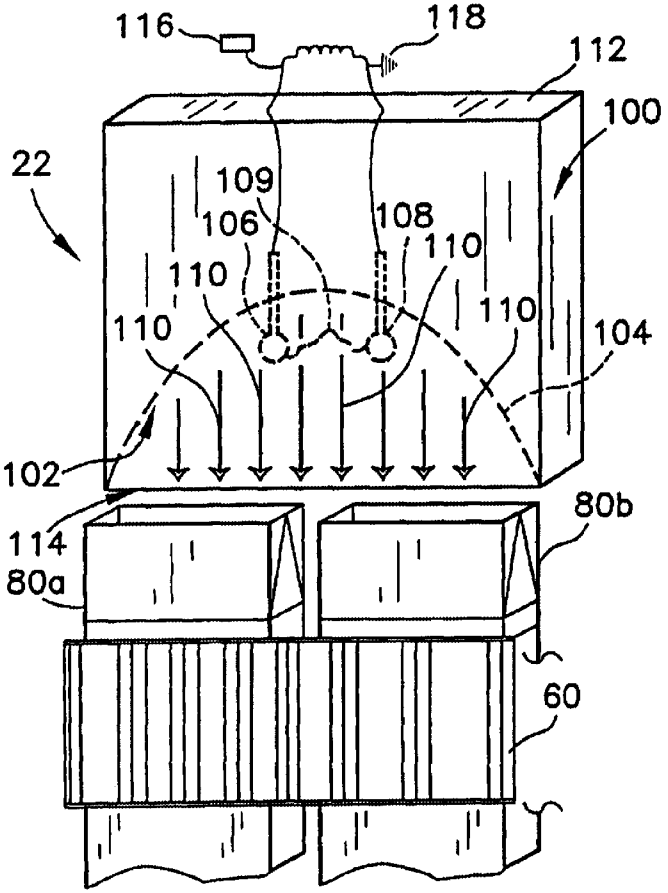
FIG. 2*a* is an isolated view of the defoaming device of FIG. 2.

The positioning of the defoaming device 22 over a dual processing line is best shown in FIG. 3. Two cartons 80a,b are positioned below the defoaming device 22. The defoaming device 22 has a body 100 that defines a recessed cavity 102. Preferably, the recessed cavity 102 has a parabolic shape into the body 100 thus forming a parabolic ceiling 104 of the recessed cavity 102. This ceiling 104 is reflective to direct air towards the interior of each carton 80*a,b*. Projecting from the body 100 are two electrical terminals 106 and 108. For example, terminal 106 can be a cathode and terminal 108 can be an anode. For example, a high voltage current is sent through terminal 106 thereby establishing an electrical arc 109 between terminal 106 and terminal 108. A sonic shock wave, illustrated by arrows 110, is created by the electrical discharge. The shock wave 110 arises from the super-heating of the air within the recessed cavity 102 by the electrical discharge, similar to lightening. As the air heats, it expands thereby increasing the pressure within the recessed cavity 102. The sonic shock wave 110, or compressed air, is directed toward the interior of the cartons 80*a,b* to destroy the foam bubbles thereby defoaming the product in anticipation of pre-folding. The reflective ceiling 104 acts to reflect all vectors of the shock wave toward the interior of the cartons 80*a,b* to increase the defoaming effect of the shock wave 110. However, those skilled in the art will recognize that the ceiling 104 may be of a non-parabolic shape and be within the scope and spirit of the present invention.

The body 100 may be encapsulated by a protective shield 112 composed of a metal or other protective material. Also, a protective screen 114 may be placed over the recessed cavity to prevent contact with the terminals 106 and 108. The screen 114 may also be a radio frequency filter to absorb radio waves created with the sonic shock wave. The radio waves may have a deleterious effect on the operation of the packaging machine. A power supply 116 is connected to the terminals 106 or 108 to supply the high voltage current. One of the terminals 106 or 108 may also be connected to a ground 118.

Figure 4:
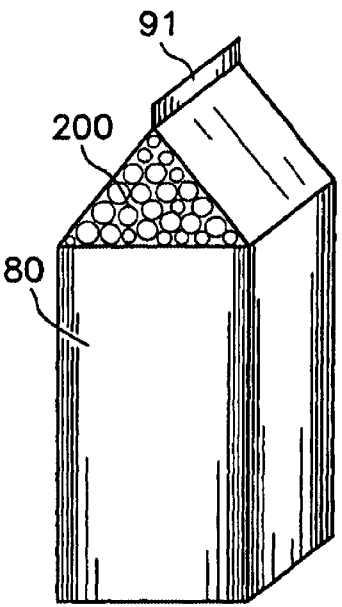
FIG. 4 is a partial cross-sectional side view of a folded top gable top carton of the prior art.

A carton 80 filled with a foamable product 201 filled therein is shown in FIG. 3. The liquid level is approximately shown at line 199. The foamable product 201 has bubbles 200 that approach the sealing areas 91 of the carton 80. The same carton 80 is illustrated in FIG. 4 undergoing pre-folding without defoaming, as performed in the prior art. As shown in FIG. 4, the bubbles 200 of the foamable product 201 "wet" the sealing areas 91 of the carton 80. Such wetting will interfere with proper sealing of the carton 80 and render the product filled carton 80 defective. For example, in a carton 80 having a cross section of 70 mm×70 mm, a ten millimeter thick layer of foam will require approximately forty-nine milliliters of volume. In a typical one liter carton, the volume between the level of the product and the top of the carton is approximately forty-nine milliliters. Thus, it is obvious that the foam will wet the sealing area if the carton is not defoamed, or allowed to settle prior to sealing.

Figure 5A:
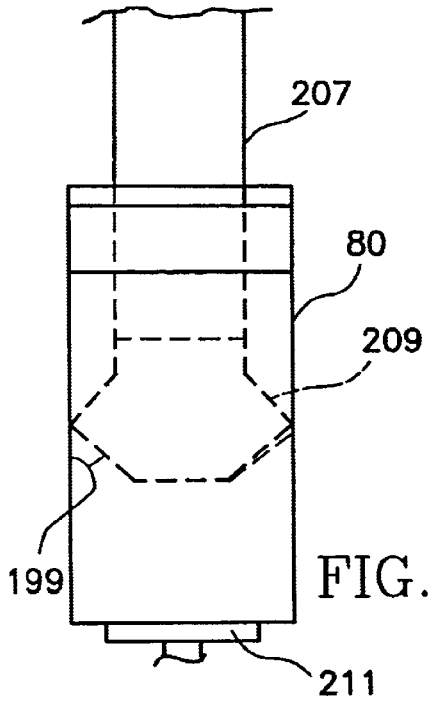
FIG. 5*a* illustrates a gable top carton being filled with a foamable product.
Figure 5B:
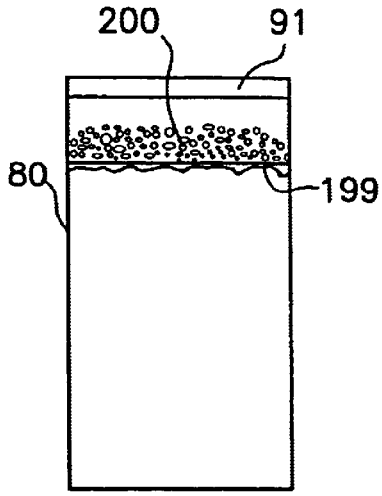
FIG. 5*b* illustrates a filled gable top carton with foam.
Figure 5C:
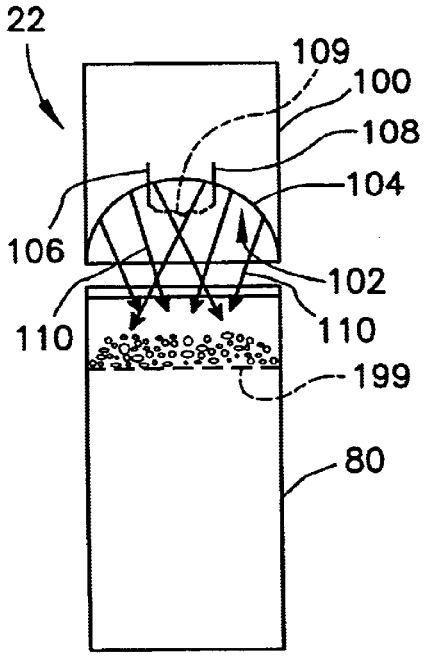
FIG. 5*c* illustrates a filled gable top carton being defoamed at the defoaming device of the present invention.
Figure 5D:
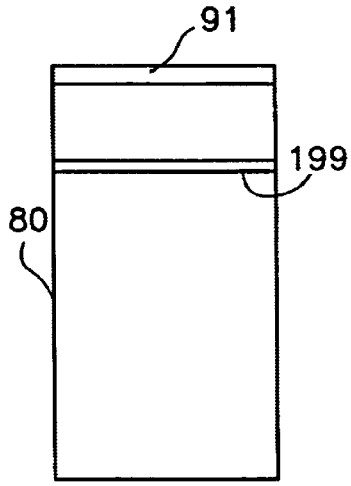
FIG. 5*d* illustrates a defoamed gable top carton.

FIGS. 5*a–d* illustrate the filling, defoaming and pre-folding of a single carton. In FIG. 5*a*, a carton 80 is bottom-up filled with a foamable product 201 such as milk. A fill pipe 207 with a nozzle 209 attached thereon fills the carton as it is lowered on a lifter 211. The liquid level 199 remains in proximity to the nozzle 209 during the entire filling process to reduce the amount of foaming. In FIG. 5*b*, the carton 80 is now filled with a foamable product 201 and conveyed to the defoaming device 22. The carton may contain any volume from one liter to one half gallon to one gallon. The cross-section of the carton may vary, for example from a 70 mm×70 mm cross section to a 47 mm×47 mm cross-section to a 70 mm×95 mm cross section. In FIG. 5*c*, the defoaming device 22 is defoaming the carton. The terminals 106 and 108 create an electrical discharge, and the heated air in the form of one or more shock waves 10 is directed by the reflective ceiling 104 toward the bubbles 200 of the foam of the foamable product 201. A single electrical discharge with an energy of $2\times10^{-5}$ joules has been found to be sufficient to collapse all of the foam bubbles in a carton having a cross-section of 70 mm×70 mm. The voltage delivered may be 15 kilovolts and the distance between the electrodes and the foam may be 1 to 2 centimeters. However, other parameters may be used in practicing the present invention. In FIG. 5*d*, a carton with a defoamed product is ready for pre-folding.

Figure 6A:
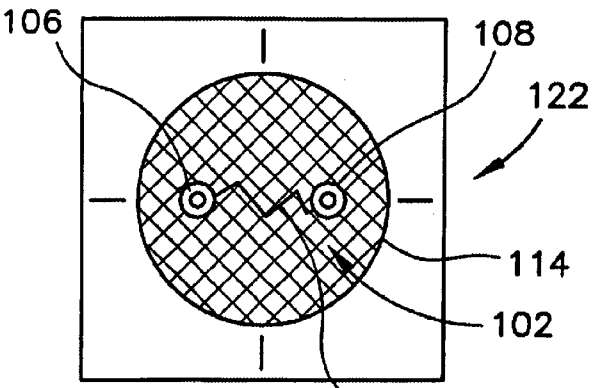
FIG. 6*a* is a cross-sectional plan view of the apparatus of FIG. 6, more clearly illustrating the filter/screen of the apparatus.
Figure 6:
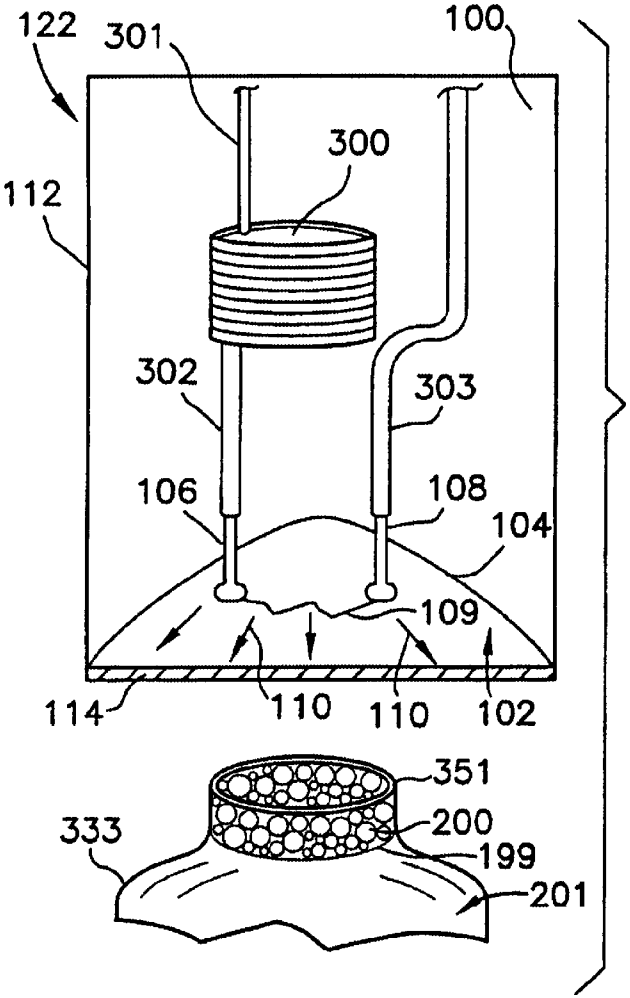
FIG. 6 is an isolated view of an alternate embodiment of the defoaming apparatus of the present invention over a plastic container such as a PET bottle which can be filled on a rotary filling machine.

An alternate embodiment of the defoaming apparatus 122 is illustrated in FIGS. 6 and 6*a*. The alternative defoaming apparatus 122 is constructed as a semi-isolated component on a machine. In this embodiment, the defoaming apparatus 122 has a built-in step-up transformer 300 that receives standard voltage from a power supply along standard voltage line 301, and transforms the electricity to a higher voltage for delivery to a high voltage power line 302 and to the electrode 106. A ground 303 is connected to electrode 108 for delivering the after-effects of the arc/charge 109 to ground.

Figure 10:
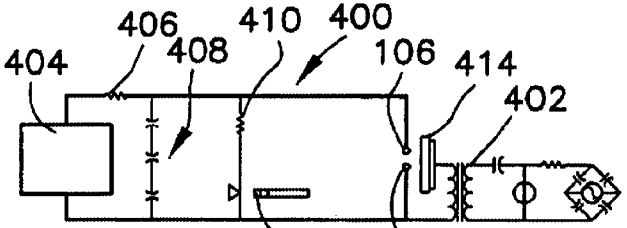
FIG. 10 is an electrical schematic diagram of a trigger circuit used in one embodiment of the present invention.

In a present embodiment, the electrical circuit 400 includes a trigger circuit 402, as shown in FIG. 10. The electrical circuit 400 includes a high voltage power supply 404, a current limiting resistor 406, a storage capacitor bank 408, a discharge resistor 410, a discharge relay 412 and the electrodes 106, 108. The trigger circuit 402 enables the initiation of a spark upon receipt of a control signal. It has been observed that in a circuit without a trigger circuit, a spark will initiate when the potential (voltage) across the electrodes reaches a "value" sufficient to overcome the resistance of the air between the electrodes. As will be recognized by those skilled in the art, this "value" can be dependent upon a number of external or environmental factors, such as temperature, humidity, ion concentrations and the like.

To overcome the potential for inadvertent spark initiation, the trigger circuit 402 uses an ionization method in which a high voltage trigger pulse is applied to one side of an insulating plate 414. This ionizes the gas (typically air) between the electrodes 106, 108 to initiate the discharge (spark).

Figure 11:
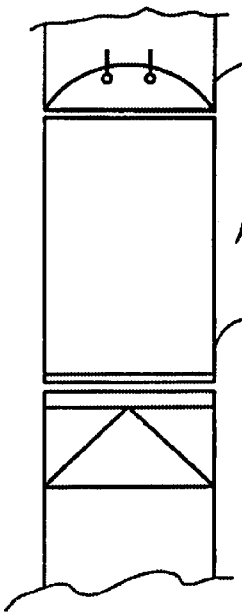
FIG. 11 illustrates a sound guide that is used in one embodiment of the invention.

In an effort to further reduce the opportunity for inadvertent spark initiation, it has been found that it is desirable to minimize or eliminate fouling the electrodes 106, 108, which can occur by, for example, the accumulation of ionic material (salts, milk, juice, soap and the like) on the electrodes 106, 108. As will be recognized by those skilled in the art, electrode 106, 108 fouling can affect the spark, and typically compromises spark generation by lowering the resistance path from the high voltage electrode 106 to ground. It has been found that fouling can be reduced or eliminated by spacing the defoaming device body 100 and electrodes 106, 108 from the product as it is filled into the carton 80. In such an arrangement, a sound guide 500, such as that illustrated in FIG. 11, can be positioned between the body 100 and the carton 80. In this manner, any liquid that may project as the foam or bubbles collapse will not project so far as to contact, land on, or accumulate on the defoaming device 22 and in particular on the electrodes 106, 108. In one embodiment, as illustrated in FIG. 11, the sound guide 500 has a body 502 that is configured as an elongated cylindrical tube. The tubular body 502 essentially envelopes the shock waves 110 that emante from the spark and directs the waves 110 onto the foamed product 201 in the carton 80.

As shown in FIG. 6, the foamable product 201 is filled into a plastic container 333 having a rim 351. The plastic container 333 maybe any type of plastic container such as a PET bottle, a high-density polyethylene bottle, or the like. The product may be any type of foamable product such as milk, cranberry juice, pineapple juice and grapefruit juice, as well as other foamable food products, and other foamable non-food products. The apparatus 22 may be integrated on various types of filling machines such as rotary fillers, linear fillers, vertical fillers and even in batch foamable product processing units. The defoaming apparatus 22 of the embodiment of FIG. 6 obviates the need for connecting high voltage power lines to the machine. Such high voltage power lines may interfere with the operation of the machine and can increase the potential for injury to machine operators. The defoaming apparatus 22 is connected to a standard power supply line, for example a 110 volt power line. This electricity is then transformed to a higher voltage by the transformer 300 within the apparatus 22, thus providing a safer work environment and also limiting any interference that a high voltage line might have on a machine.

Figure 7:
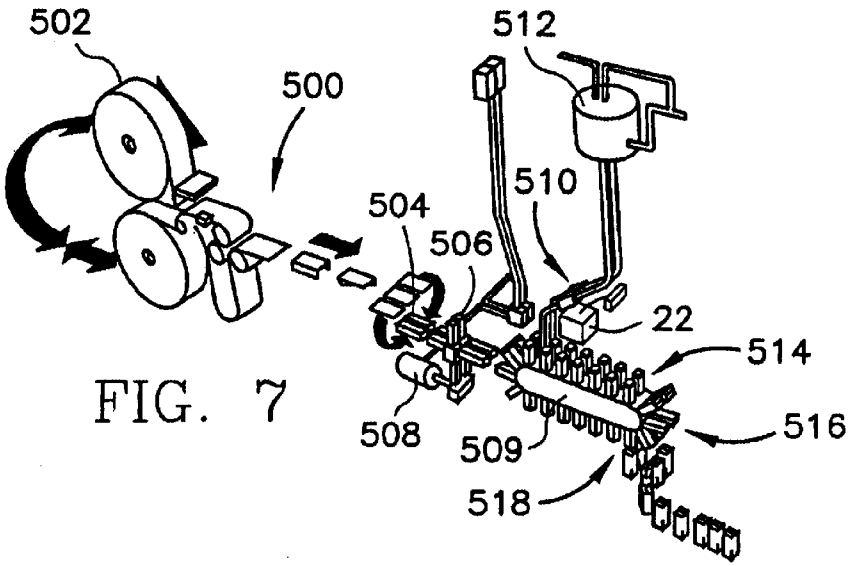
FIG. 7 a schematic view of a TETRA TOP™ packaging machine having the defoaming device of the present invention integrated thereon.

As shown in FIG. 7, an alternative packaging machine that may use the defoaming device of the present invention is generally designated 500. The machine 500 creates a package with a fiberboard based body and an injection molded plastic top known as the TETRA TOP™ package that is available from the aforementioned Tetra Pak, Incorporated. In operation, a web of material 502 is formed into a carton sleeve at a forming station 504. The sleeve is placed on a mandrel 506 and rotated to an injection molding station 508 where the plastic top is created. The partially formed package is placed on a conveyor 509. The package is filled at a filling station 510 with a foamable product 201 that is received from a product tank 512. The defoaming apparatus 22 is disposed adjacent the fill station 510, similar to the arrangement on the gable-top carton packaging machine 20. The bottom of the package is sealed at a bottom forming station 514 and the bottom flaps are sealed at a flap sealing station 516. At a discharge point 518, the package is released from the conveyor 509 for further distribution. The defoaming apparatus 22 will defoam the product filled package allowing for better bottom sealing of the package.

Figure 9:
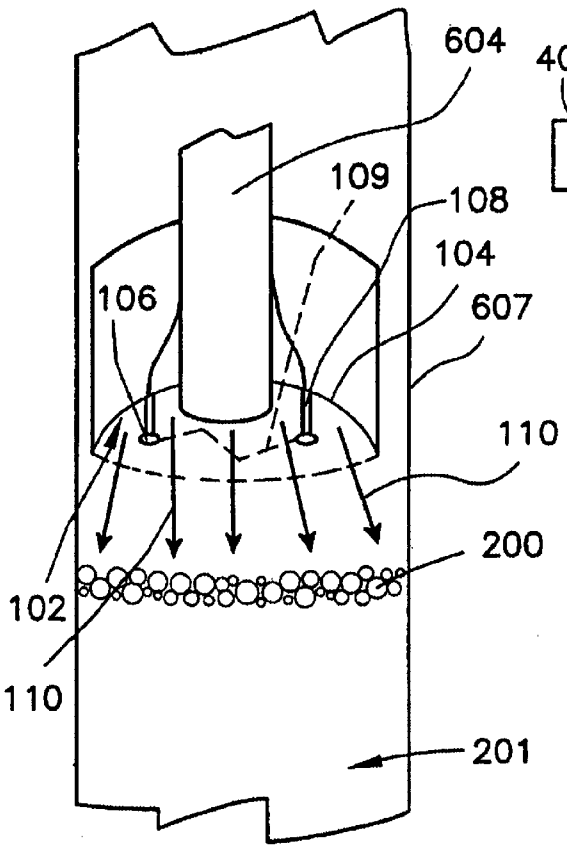
FIG. 9 is a cross-sectional view of the machine FIG. 8 with the defoaming device of the present invention disposed about the fill pipe.
Figure 8:
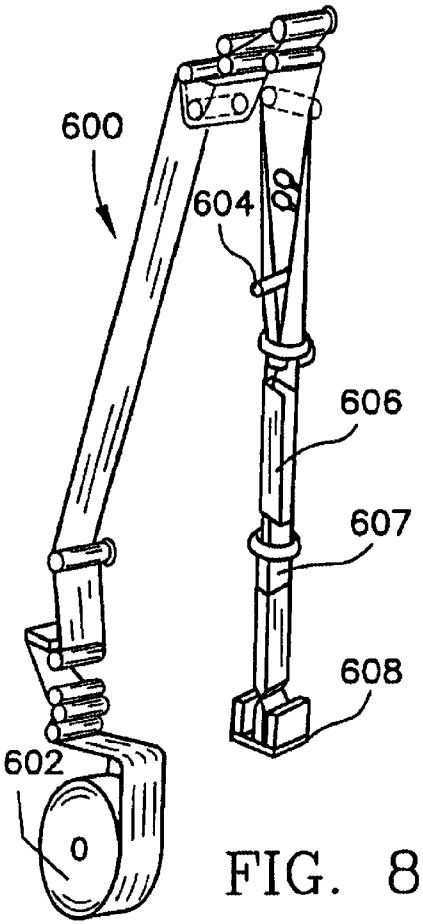
FIG. 8 is a schematic diagram of a vertical form, fill and seal packaging machine.

Yet another packaging machine that may utilize the apparatus 22 is a vertical form, fill and seal packaging machine. An example of such a machine is shown in FIGS. 8 and 9. The machine fabricates fiberboard packages such as the ubiquitous TETRA BRIK® package, or flexible plastic pouches such as a TETRA POUCH™ package. As shown in FIG. 8, the vertical packaging machine 600 receives a web of material 602. The material 602 is formed around a fill tube 604. The material is formed into a tube 607 by a longitudinal sealer 606. The package is then cut-away from the tube 607 at a transversal sealer 608. As shown in FIG. 9, the defoaming apparatus 22 can be mounted about the fill pipe 604 between the longitudinal sealer 606 and the transversal sealer 608. The apparatus 22 can also contact the bubbles 200 and/or the foamable product 201.

From the foregoing, it will be observed that numerous modifications and variations can be effectuated without departing from the true spirit and scope of the normal concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A defoaming device for a packaging machine for filling a series of containers and sealing the containers, the defoaming device comprising:

a body having a reflective recessed cavity, the body positioned over the container path;

a first electrical terminal within the reflective recessed cavity;

a second electrical terminal within the reflective recessed cavity, the second electrical terminal in electrical proximity to the first electrical terminal;

a power supply in electrical flow communication with the first electrical terminal to provide a high voltage current to the first electrical terminal in order to create an arc between the first electrical terminal and the second electrical terminal so as to generate a shock wave; and a trigger circuit having a conductive element disposed in electrical proximity to the first and second electrical terminals to initiate arc generation.

2. The defoaming device in accordance with claim 1 further comprising a protective shield about the body.

3. The defoaming device in accordance with claim 1 further comprising a radio frequency filter placed at an opening to the recessed cavity.

4. The defoaming device in accordance with claim 1 wherein the defoaming device is positioned prior to a pre-folding station of the packaging machine.

5. The defoaming device in accordance with claim 1 wherein the perimeter of the recessed cavity encompasses two containers for simultaneous defoaming.

6. The defoaming device in accordance with claim 1 including a sound guide disposed adjacent the body and configured to direct the shock wave.

7. A method for processing a series of containers on a packaging machine the method comprising the steps of:

filling a container with a foamable product at a fill station of the packaging machine;

defoaming the product in the container by creating an electrical discharge within a recessed cavity of a body of a defoaming device, the recessed cavity having a reflective ceiling, the electrical discharge generating a shock wave that is directed onto the foamable product in the container;

providing a trigger circuit having a conductive element in electrical proximity to the defoaming device;

generating the electrical discharge by actuating the trigger circuit; and sealing the top of the container to create a filled and sealed container.

8. The method in accordance with claim 7 wherein the container is a carton and further comprising the step of prefolding a plurality of top panels of the carton prior to sealing.

9. The method in accordance with claim 7 wherein the electrical discharge superheats the air inside of the recessed cavity creating a shock wave that collapses foam inside of the container.

10. The method in accordance with claim 7 wherein the foamable product is milk.

11. The method in accordance with claim 7 wherein a single electrical discharge is applied to every container.

12. A packaging machine having a series of cartons conveyed along a path, the packaging machine comprising:

a filling station for filling each of the cartons with a foamable product;

a top sealing station for sealing a plurality of top panels for each of the cartons to create a formed, filled and sealed carton; and a defoaming device disposed between the filling station and the top sealing station, the defoaming device for defoaming a filled carton, the defoaming device comprising a body having a reflective recessed cavity, the body positioned over the carton path;

a first electrical terminal within the reflective recessed cavity;

a second electrical terminal within the reflective recessed cavity, the second electrical terminal in electrical proximity to the first electrical terminal;

a power supply in electrical flow communication with the first electrical terminal to provide a high voltage current to the first electrical terminal in order to create an arc between the first electrical terminal and the second electrical terminal, so as to generate a shock wave; and a trigger circuit having a conductive element disposed in electrical proximity to the first and second electrical terminals to initiate arc generation.

13. The packaging machine in accordance with claim 13 wherein the defoaming device further comprises a protective shield about the body.

14. The packaging machine in accordance with claim 12 wherein the defoaming device further comprises a protective screen placed at an opening to the recessed cavity.

15. The packaging machine in accordance with claim 12 further comprising a pre-folding station for pre-folding the top panels of each carton prior to sealing.

16. The packaging machine in accordance with claim 12 wherein the perimeter of the recessed cavity encompasses two cartons for simultaneous defoaming.

17. The packaging machine in accordance with claim 12 including a sound guide disposed between the defoaming device body and the filled carton, the sound guide configured to direct the shock wave about the filled carton.

18. An apparatus for defoaming a foamable product dispersed into a container, the defoaming apparatus comprising:

a body having a reflective recessed cavity, the body positioned over the container;

a first electrical terminal within the reflective recessed cavity;

a second electrical terminal within the reflective recessed cavity, the second electrical terminal in electrical proximity to the first electrical terminal; and a step-up transformer for creating a high voltage current from a standard voltage current in electrical flow communication with the first electrical terminal to provide a high voltage current to the first electrical terminal in order to create an arc between the first electrical terminal and the second electrical terminal, so as to create a shock wave, and including a trigger circuit having a conductive element disposed in electrical proximity to the first and second electrical terminals to initiate arc generation.

* * * * *